United States Patent [19]

Rosier et al.

[11] Patent Number: 4,741,057

[45] Date of Patent: May 3, 1988

[54] RELAXATION MATTRESS

[75] Inventors: Pascal Rosier; Sully-Pierre Rosier, both of Paris, France

[73] Assignee: Nat-Relax S.A.R.L., Paris, France

[21] Appl. No.: 877,372

[22] Filed: Jun. 23, 1986

[30] Foreign Application Priority Data

Jul. 12, 1985 [FR] France ..... 85 10715

[51] Int. Cl.[4] ..... B32B 3/12

[52] U.S. Cl. ..... 5/455; 441/129; 5/481; 5/449

[58] Field of Search ..... 5/455, 456, 457, 458, 5/446, 481, 449; 428/178, 120, 166; 441/35, 113, 127, 129, 130

[56] References Cited

U.S. PATENT DOCUMENTS

| | | | |
|---|---|---|---|
| 2,193,750 | 3/1940 | Welker | 5/455 |
| 2,434,641 | 1/1948 | Burns | 5/449 |
| 3,102,280 | 9/1963 | Williams | 441/130 |
| 3,363,272 | 1/1968 | Channon | 441/129 |
| 3,553,068 | 1/1971 | Coale | 428/178 |
| 4,005,236 | 1/1977 | Graebe . | |
| 4,099,269 | 7/1978 | Porner | 428/178 |
| 4,181,548 | 1/1980 | Weingarten | 5/455 |
| 4,287,250 | 9/1981 | Rudy | 428/178 |
| 4,406,628 | 9/1983 | Rademacher | 441/129 |
| 4,428,087 | 1/1984 | Horn | 5/455 |
| 4,571,195 | 2/1986 | Brooks | 441/74 |
| 4,666,414 | 5/1987 | Fox | 441/129 |

FOREIGN PATENT DOCUMENTS

| | | | |
|---|---|---|---|
| 488628 | 12/1975 | Australia | 5/449 |
| 1951476 | 8/1971 | Fed. Rep. of Germany . | |

OTHER PUBLICATIONS

Popular Mechanics, Aug. 1959, p. 89.

*Primary Examiner*—John E. Murtagh

*Attorney, Agent, or Firm*—McAulay, Fields, Fisher, Goldstein & Nissen

[57] ABSTRACT

The mattress comprises two successive, coupled and superimposed layers (6, 7), each layer being formed from a fluidtight surrounding wall. The first layer (6), adapted to receive the body of the user, contains a plurality of adjacent but separate air bubbles (8) having a substantially identical volume at all points of the layer. The second layer (7) contains air bubbles (10) which are adjacent and separate but have different volumes according to their location in the second layer. The bubbles of the second layer have a volume proportional to the relative density of the various parts of the body of the user stretched out on the mattress. Application in medical uses or swimming pool or seaside amusement.

18 Claims, 1 Drawing Sheet

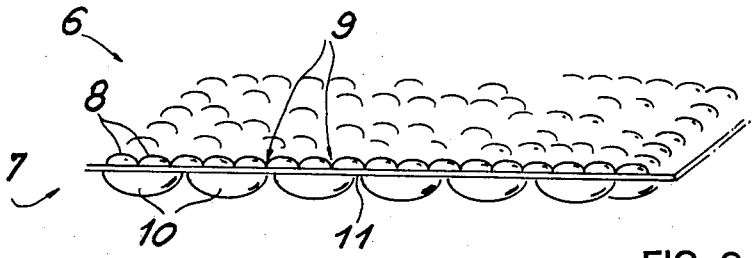
FIG. 2
FIG 1
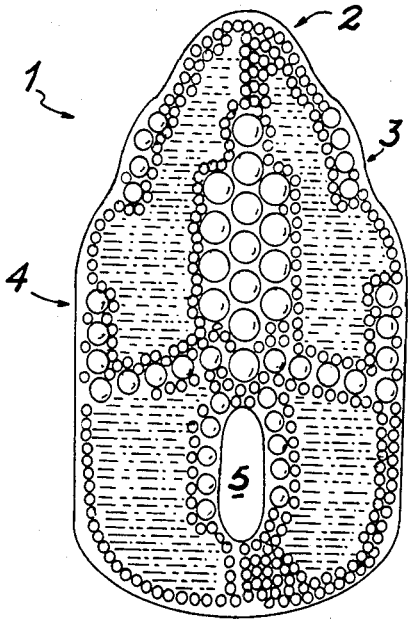
FIG. 3
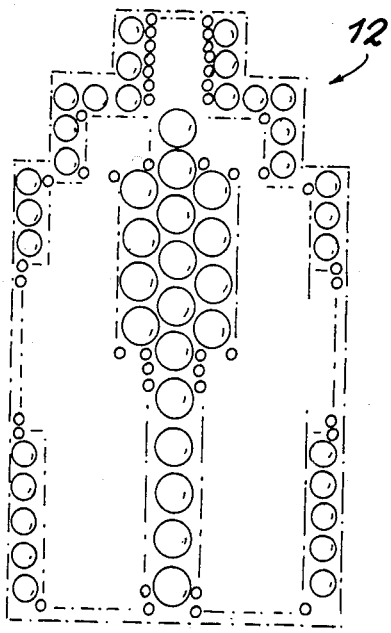

RELAXATION MATTRESS

The present invention relates to a relaxation mattress adapted in particular to support a user floating under water so that the major part of his body is immersed just under the surface of the water, the only part emerging in an extended position on the mattress being the face, and in particular the nose and mouth, of the user.

The advantages of body relaxation from both a physical and psychical point of view are known. It is also known that this relaxation is all the more effective if the body of the individual is placed in an environment which exerts on him a gentle massaging action or simply provides a balanced support. The use of floating techniques is in this respect of particular interest as it permits maintaining the body in a surrounding medium whose temperature, content of salt or other mineral agents, density, etc. may be adjusted as required. Further, apart from medical or treatment adaptations, the pleasure afforded by the use of floating mattresses is known at the swimming pool or seaside.

However, these well-known articles, generally constituted by a fluidtight surrounding wall of rubber or plastics material inflated with air, do not enable the person who uses the mattress to float under the water and above all do not maintain the body of the user in a perfectly stretched out position owing to the difference between the weight of the various parts of his body which exert on the mattress forces of distinct magnitude and consequently modify the flatness of the mattress. In the particular case of medical applications of such mattresses, the latter are consequently usually excluded, since they constitute in their conventional form articles of games rather than efficient and medically-recognized soothing and relaxing instruments.

An object of the invention is to provide a relaxation mattress which avoids these drawbacks and in particular enables the body of a user, stretched out on the mattress, to float under water while being maintained perfectly flat, this body keeping a planar, or very substantially planar, shape at all points of its surface.

For this purpose, the considered mattress comprises two successive coupled and superimposed layers each formed by a fluidtight surrounding wall, the first surrounding wall, which is adapted to receive the body of the user, containing a plurality of adjacent but separate bubbles of air having a substantially identical volume at all points of said layer, and the second layer containing air bubbles which are also adjacent and separate but have different volumes according to their location in said second layer, the bubbles of the second layer having a volume proportional to the relative density of the different parts of the body of the user stretched out on the mattress.

Thus, by providing in the second layer, located under the first layer, air bubbles having volumes which vary in the extent of the layer, there is provided a support adapted to the body of the user stretched out on the mattress by opposing to the weight of the body, by the Archimedean thrust, a variable force which is large in the region of the most dense parts of the body, such as the head, the pelvis and the trunk, and less in the other parts.

There is in this way achieved a stabilization of the user in the ideal, perfectly planar position which substantially facilitates the desired relaxing effect with a notable improvement in the reaction opposed by the mattress to the weight it supports. In particular, it thus becomes possible to conform to the shape of the body at all points of the latter and especially to provide a support for the spine of the user in an exactly horizontal position, this part of the body constituting a particularly sensitive zone whose effect on relaxation is primordial.

According to a particular feature of the invention, the mattress has a geometric shape adapted to the general morphology of the body of the user with in particular a cavity on each side of the legs of the user.

In particular, the mattress has a narrower part under the head and trunk of the user to permit the free passage of the arms of the latter and a wider part under the trunk and on each side of the legs of the user.

As a modification, the mattress has any geometric shape, in particular a rectangular shape or a shape having set-back parts in the region of the head and trunk so as to facilitate the mass-production of the mattress.

Further, also, according to various modifications of a relaxation mattress according to this invention, the superimposed layers of the mattress may be made from a plastics material or rubber in particular, and preferably from plastics foam materials of polyethylene or the like.

Further features of a relaxation mattress according to the invention will be apparent from the following description of an embodiment which is given merely by way of a nonlimiting example with reference to the accompanying drawings, in which:

FIG. 1 is a top plan view of a relaxation mattress according to a first embodiment of the invention with a part cut away;

FIG. 2 is a side elevational and sectional view of a detail of the considered mattress, illustrating in particular the structure in the form of two superimposed layers of the latter, and FIG. 3 is a top plan view of another embodiment of the invention.

In the embodiment shown in FIG. 1, the mattress according to the invention, generally designated by the reference charactor 1, has a special contour adapted in particular to the morphology of the user stretched out on this mattress and floating below the surface of the water owing to the action of this mattress. The narrower part 2 is adapted to serve as a support for the head of the user, the part 3 for the trunk of the latter, and the part 4 for the rest of the body, in particular the legs extended equally on each side of the mattress. Advantageously, the latter may include a hollowed-out part 5 between the regions of the mattress supporting the legs.

According to the invention, the foregoing mattress 1 is made from two superimposed layers 6 and 7 respectively, the upper layer 6 being adapted to receive the body of the user floating on the mattress, while the layer 7 under the layer 6 is completely immersed. the layer 6 is formed by a fluidtight surrounding wall of rubber or a suitable synthetic material in which are trapped air bubbles 8 uniformly distributed throughout the extent of this layer, these air bubbles having a substantially identical volume from one bubble to the other. These bubbles are separated by regions 9 in which the two walls of the layer 6 are in adjoining relation, the manufacture of such a layer being easy to achieve by any conventional method which, when the layer is filled with air, preforms the latter, for example in the hot state, so as to form the required bubbles.

The second layer of the mattress includes, like the first layer, adjacent air bubbles 10 extending throughout the area of the layer and separated from each other by fluidtight regions 11. However, in this case and according to an essential feature of the invention, the air bubbles 10 have a volume which may vary from one bubble to the other and in particular in accordance with their location relative to the body of the user, the bubbles of largest volume being arranged in the regions of the mattress adapted to receive the parts of the body having the highest density, such as the head, the spine and generally the principal elements of the skeleton of the user.

In the embodiment illustrated in FIG. 1, the mattress 1 has a shape which is well-adapted to that of the body of the user, which requires a special manufacture difficult to achieve in mass production. Such a mattress will therefore be more particularly intended for medical uses for floating in a controlled atmosphere and a controlled medium. On the other hand, in the embodiment shown in FIG. 3, the mattress 12 has a simple geometrical shape and is more directly appropriate for use in a swimming pool or at the seaside for pleasure and amusement.

It is of course clear from the foregoing that the scope of the invention is in no way limited to the particular form of the mattress. Further, it is obvious that the structure of the two superimposed layers could be subjected to many modifications depending on the nature of the materials from which the surrounding wall of these layers is made and the method of producing the air bubbles in the latter. Also, other structures may be envisaged in which the foregoing two superimposed layers would be associated with one or two additional protective layers or with an outer enclosing wall surrounding the whole of the mattress.

Lastly, it would be within the scope of the invention to give the air bubbles constituting the superimposed layers shapes other than spherical, for example elongated, crescent, cubical or ring shapes, etc. so as to more closely match the morphologies of the users according to the regions bearing on the mattress.

What is claimed is:

1. A relaxation mattress, comprising:

two successive coupled and superimposed layers of foamed plastics material, each said layer being formed by an individual fluidtight surrounding wall;

a first of said layers being adapted to receive the body of the user and containing a plurality of adjacent but separate air bubbles each having a substantially identical volume at all points of said first layer and each of said air bubbles being isolated from each other; and a second of said layers containing air bubbles which are also adjacent and separate but have different volumes according to their location in said second layer, the air bubbles of the second layer having a volume which is proportional to the relative density of the various parts of the body of the user stretched out on the mattress.

2. A relaxation mattress according to claim 1, having a geometric shape adapted to the general morphology of the body of the user with a hollowed out part on each side of the legs of the user.

3. A relaxation mattress according to claim 1, having any geometric shape.

4. A relaxation mattress according to claim 1, having a rectangular shape.

5. A relaxation mattress according to claim 1, having a shape including set-back parts in the region of the head and trunk of the user so as to facilitate a mass-production of the mattress.

6. A relaxation mattress according to claim 1, wherein the superimposed layers of the mattress are made from a plastics material.

7. A relaxation mattress according to claim 1, wherein said first layer is formed by a fluidtight surrounding wall forming an upper surrounding wall and a lower surrounding wall, and including regions where said upper and lower surrounding walls are joined to each other in adjoining relationship for completely enclosing each said air bubble in said first layer and isolating it from the other air bubbles in said first layer and said second layer.

8. A relaxation mattress according to claim 1, wherein said second layer is formed by a fluidtight surrounding wall forming an upper surrounding wall and a lower surrounding wall; and including regions whereat said upper and said lower surrounding walls are joined to each other in adjacent relationship forming a unitary structure for completely enclosing each said air bubble in said second layer and isolating it from the other air bubbles in said first and second layers such that all of said air bubbles are free of interconnection with any of the other of said air bubbles.

9. A relaxation mattress according to claim 1, wherein each of said layers have a flat wall and an undulating wall, and regions joining said flat wall to said undulating wall to enclose and isolate all of said air bubbles from each other, and said flat wall of each of said layers being joined to each other so that said side of said mattress has an exposed undulating wall.

10. A relaxation mattress according to claim 1 wherein said foam is of polyethylene.

11. A relaxation mattress, comprising:

two successive coupled and superimposed layers of foamed plastics material, each said layer being formed by an individual fluidtight surrounding wall;

a first of said layers being adapted to receive the body of the user and containing a plurality of adjacent but separate air bubbles each having a substantially identical volume at all points of said first layer and each of said air bubbles being isolated from each other; and a second of said layers containing air bubbles which are also adjacent and separate but have different volumes according to their location in said second layer, the air bubbles of the second layer having a volume which is proportional to the relative density of the various parts of the body of the user stretched out on the mattress;

said air bubbles in said second layer being isolated from each other and from the air bubbles in said first layer and cooperating with the air bubbles in said first layer for maintaining the body of the user when stretched out on said first layer to float under water while being maintained flat, whereby the body is maintained in a substantially planar shape at all points of the surface of the mattress.

12. A relaxation mattress according to claim 11, wherein said first layer is formed by a fluidtight surrounding wall forming an upper surrounding wall and a lower surrounding wall; and including regions where said upper and lower surrounding walls are joined to each other in adjoining relationship for completely enclosing each said air bubble in said first layer and isolating it from the other air bubbles in said first layer and said second layer.

13. A relaxation mattress according to claim 11, wherein said second layer is formed by a fluidtight surrounding wall forming an upper surrounding wall and a lower surrounding wall; and including regions whereat said upper and said lower surrounding walls are joined to each other in adjacent relationship forming a unitary structure for completely enclosing each said air bubble in said second layer and isolating it from the other air bubbles in said first and second layers such that all of said air bubbles are free of interconnection with any of the other of said air bubbles.

14. A relaxation mattress according to claim 12, wherein said second layer is formed by a fluidtight surrounding wall forming an upper surrounding wall and a lower surrounding wall; and including regions whereat said upper and said lower surrounding walls are joined to each other in adjacent relationship forming a unitary structure for completely enclosing each said air bubble in said second layer and isolating it from the other air bubbles in said first and second layers such that all of said air bubbles are free of interconnection with any of the other of said air bubbles.

15. A relaxation mattress according to claim 14, wherein said upper surrounding wall of said second layer is joined to said lower surrounding wall of said first layer.

16. A relaxation mattress according to claim 11, wheren the bubbles of largest volume in said second layer being arranged in the region of the mattress are adapted to receive the parts of the body having the highest density.

17. A relaxation mattress according to claim 15, wherein the bubbles of largest volume in said second layer being arranged in the region of the mattress are adapted to receive the parts of the body having the highest density.

18. a relaxation mattress, comprising two successive coupled and superimposed layers, each said layer being formed by an individual fluidtight surrounding wall;

a first of said layers being adapted to receive the body of the user and containing a plurality of adjacent but separate air bubbles each having a substantially identical volume at all points of said first layer and each of said air bubbles being isolated from each other; and a second of said layers containing air bubbles which are also adjacent to their location in said second layer, the air bubbles of the second layer having the largest volume being arranged in the region of the mattress adapted to receive the parts of the body having the highest density;

said air bubbles in said second layer being isolated from each other and from the air bubbles in said first layer and cooperating with the air bubbles in said first layer for maintaining the body of the user when stretched out on said first layer and allowing the body to float under water while being maintained flat, whereby the body is maintained in a substantially planar shape at all points of the surface of the mattress; and said mattress having a narrow part under the head and trunk of the user to allow the full passage of the arms of the user and a wider part under the trunk and each side of the legs of the user.

* * * * *